United States Patent [19]

Pesek

[11] 3,999,564

[45] Dec. 28, 1976

[54] CONTINUOUS ETCHING AND ETCHED MATERIAL RECOVERY SYSTEM

[75] Inventor: C. Paul Pesek, Long Lake, Minn.

[73] Assignee: Pesek Engineering & Mfg. Co., Minneapolis, Minn.

[22] Filed: Jan. 9, 1976

[21] Appl. No.: 647,796

[52] U.S. Cl. ..... 134/57 R; 134/111; 156/345

[51] Int. Cl.[2] ..... B08B 3/10; C23F 1/00

[58] Field of Search ..... 134/57 R, 109, 111; 156/19, 345

[56] References Cited

UNITED STATES PATENTS

| | | | |
|---|---|---|---|
| 3,266,502 | 8/1966 | Copeland | 134/111 X |
| 3,327,721 | 6/1967 | Carlson | 134/111 |
| 3,427,198 | 2/1969 | Hill | 134/57 R X |
| 3,526,560 | 9/1970 | Thomas | 156/345 |
| 3,806,393 | 4/1974 | Haas | 156/345 |
| 3,933,544 | 1/1976 | Haas | 156/19 |

*Primary Examiner*—Robert L. Bleutge
*Attorney, Agent, or Firm*—James R. Cwayna

[57] ABSTRACT

A system and the required apparatus to provide a continuous recovery for the material being etched including the system and apparatus for recycling the etchant material for reuse in the etching device. The system includes a device for etching, an ammoniating system for the constant restoration of the etchant to a proper pH level for efficient alkaline etching and a controlled system for the systematic removal of the material which is etched and is in solution within the etchant, which controlled system includes the regeneration of the etchant material.

16 Claims, 3 Drawing Figures

CONTINUOUS ETCHING AND ETCHED MATERIAL RECOVERY SYSTEM

BACKGROUND AND OBJECTS OF THE INVENTION

The art of chemical etching is well known. Various systems have been provided for continuous etching of material by continually providing fresh etchant into the etching device with discharge thereof after the same has become saturated with the material to be removed by the etching process. The continuity of these processes is provided by the constant provision of fresh etchant to the system and not by the regeneration or reuse of the etchant.

With applicant's concept, a new system for the continuous etching and recovery of the material etched from the process with a recycling and regeneration of the etchant material from which the material etched is recovered is provided. The recycling of the etchant subsequent to the material removal therefrom provides a substantial savings to the user and substantially provides a system which may be considered to be closed loop in its usage.

With the various situations encountered in applicant's system, accommodation must be made for the differences required in the etching, regeneration and the material removal stages for proper functioning of the unit.

It is therefore an object of applicant's invention to provide a system for continuous etching of materials and particularly copper which provides for the continuous regeneration and reuse of the etchant.

It is a further object of applicant's invention to provide a system for the continuous etching of materials and particularly copper which provides for the removal of the etched copper from the etchant solution and thereafter redirecting the copper free etchant back into the etching procedure.

It is a further object of applicant's invention to provide a system for the continuous operation of an etching device which system includes the regeneration of the etchant material continuously during the operation of the etching device and further provides for the continuous, selective removal of the material etched from the etchant material without disrupting the operation of the etching device.

It is still a further object of applicant's invention to provide a continuous etching system which is effectively a closed loop system and does not require complete substitution and replacement of the etchant into the loop.

These and other objects and advantages of applicant's invention will more fully appear from the accompanying description made in association with the accompanying drawings in which the same numeral is utilized to identify the same or similar parts throughout the several views, and in which.

Figures 1, 2, 3:
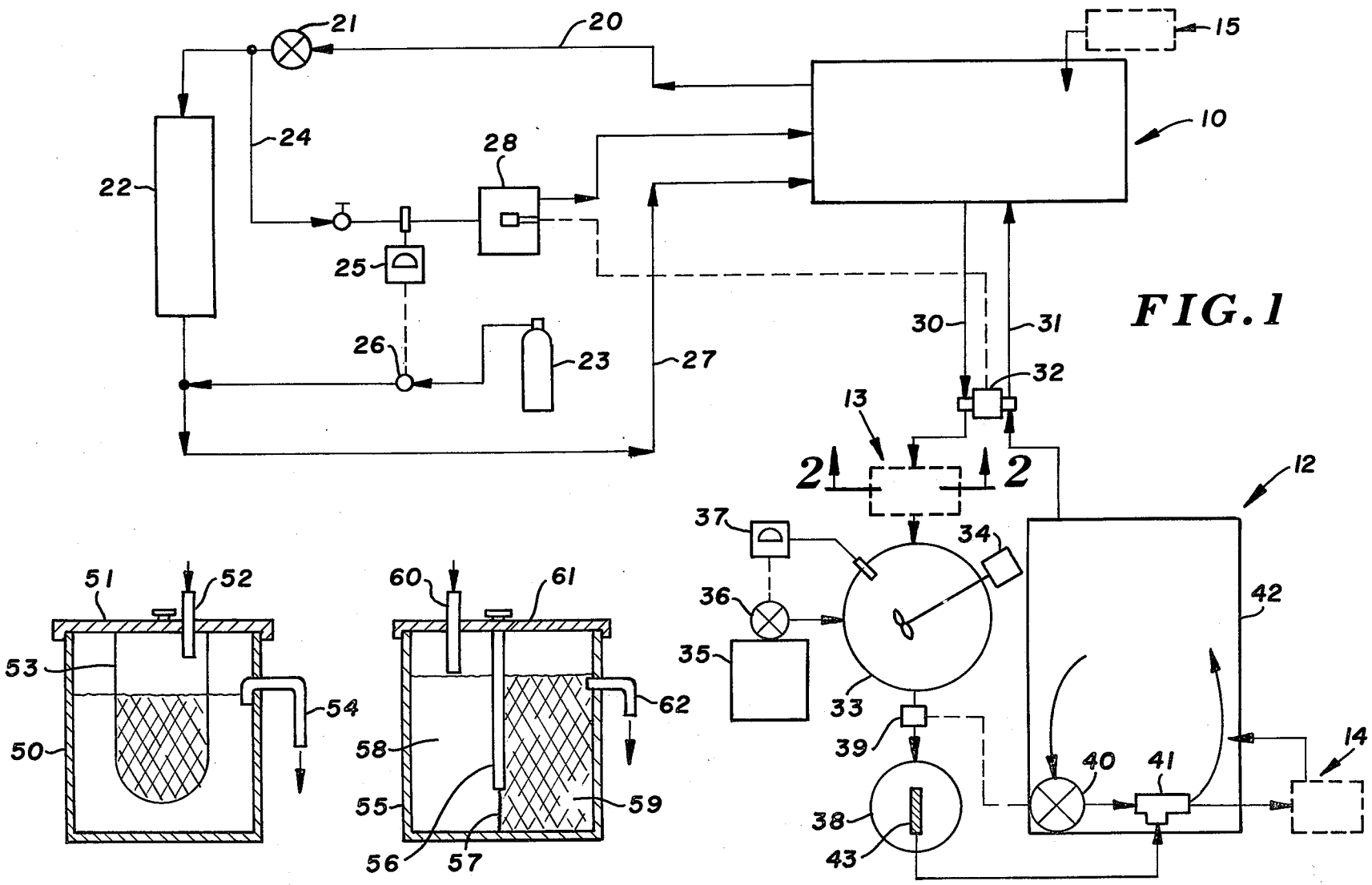
FIG. 1 is a schematic illustration of the circuitry embodying the concepts of applicant's invention and illustrating, through utilization of dotted portions thereof, the various alternative locations for the addition of certain chemicals into the system.
FIG. 2 is a section taken along Line 2—2 of FIG. 1 and illustrating a first form of a device for the introduction of chemical into the system; and, FIG. 3 is a section similar to FIG. 2 and illustrating a modified form of the unit for the introduction of chemicals into the system.

In accordance with the accompanying drawings, applicant's apparatus for the operation of a continuous etching system and as will be described herein as being related to a system for the continuous etching of copper includes an etcher 10, an ammoniating circuit 11 and a precipitation or material recovery circuit 12. As also illustrated in FIG. 1 and as will be discussed hereinafter, provision is made in the circuitry for the addition of ammonium chloride to the etchant material and three locations for the same are illustrated. These various locations are designated 13, 14 and 15. The structure that may be utilized at locations 13, 14 are embodied in the structures of FIGS. 2 and 3 and these, likewise, will be described hereinafter.

The etcher construction employed in this circuitry is capable of continuous material movement therethrough and such etchers are commonly known in the art. Such an etcher will normally contain and provide means for directing the material to etched therethrough while directing the etchant material to the selected surfaces thereof. The etchant normally available in the etchant will pass into a sump after striking the material and will be recirculated within the etching device. In the prior art units, after the etchant has been utilized and the specific gravity thereof has reached a predetermined level, the same will be discharged and fresh etchant will be introduced. With a relatively short replacement time, the etching process may be termed to be "continuous".

The ammoniating circuitry includes a withdrawal line 20 directing etchant from the etching device to an ammoniating device such as an ammoniating tower 22. This withdrawal may be accomplished through a pump 21.

As copper is etched with an alkaline etchant the available ammonia ions are tied into a copper complex. This causes the pH of the etchant to drop. When the pH of the etchant drops below a certain level, the effectiveness of the etchant to perform the etching function is diminished. The applicant has found that the etcher will perform at a high rate of efficiency when the etchant within the etching device is maintained in the range of 8.0 to 10.0. In order to maintain this pH level, it is necessary to add ammonia to the etchant.

A by-pass is provided in line 24 to monitor the pH level of the etchant from the etcher through pH monitor 25. Monitor 25 controls a solenoid valve 26 which in turn controls flow of ammonia from source 23 to the ammoniating tower 22 where it is bubbled upwardly to provide a cross flow against the etchant flowing downwardly through the tower 22.

Flow through this circuit 11 is constant and therefore when the pH level of the etchant drops below the aforementioned range, ammonia will be introduced into the etchant. As this flow is constant, it reflects the pH level of the etchant being used in the etcher. Upon reaching the upper limits of the range of pH, the solenoid valve 26 is closed to stop the flow of ammonia to the tower.

Flow through the circuit is delivered back to the etcher 10 through line 27.

Also provided in the circuit 11 is a specific gravity sensor 28 which receives etchant to be monitored through line 24. This sensor 28 controls the precipitation or material recovery circuit 12. As the flow through circuit 11 is continuous, this specific gravity monitoring is also continuous.

The specific gravity reading of the etchant is directly related to the amount of material that has been removed by the etching process and remains in solution in the etchant. When this specific gravity reaches a predetermined level, in order to maintain a proper etching rate and to prevent the settling out of the removed material in the etcher 10, the etchant is removed from the etcher and delivered to the precipitation or material recovery circuit 12. Such removal is initiated through the specific gravity reading as obtained in the ammoniating circuit 11.

The precipitation circuit 12, in the form shown and utilizing the chemical additive unit 12, includes a fluid withdrawal line 20 and a fluid replacement line 31 connected respectively to either side of a dual headed pump 32, the chemical additive device 13 receiving chemical from the withdrawal line 30, a reactor tank 33, a salt collection receptacle 38 and a feed or storage tank 42 which is connected to the dual headed pump 32 for delivery of the filtered etchant back to the etcher through the replacement line 31.

The concept of the dual headed pump is to insure the replacement of etchant back to the etcher whenever etchant is withdrawn therefrom. This will insure a constant supply and a sufficient supply of etchant to the etcher.

In this form, that of the chemical additive unit within the precipitation circuit, the fluid etchant is delivered by the pump 32 through the additive unit 13. The chemical delivered to the etchant by this additive element 13 is Ammonium Chloride. The essential elements in alkaline etchant solution are Ammonium Hydroxide ($NH_4OH$), Ammonium Chloride ($NH_4Cl$) and Water. The ammonium chloride is normally produced by the reaction of Hydrochloric Acid and Ammonia ($HCl + NH_3$) but with the structure illustrated, applicant provides a means for the direct introduction of ammonium chloride into the etchant. The addition of ammonium chloride, at this point, results in an endothermic reaction which lowers the temperature of the etchant to assist in the precipitation of material, copper, from the etchant.

By placing the ammonium chloride additive structure in the flow line prior to the reactor 33 the etchant is cooled before its introduction to the reactor and this prior ammonium chloride introduction will also help maintain a stable pH level in the reactor tank. The ammonium chloride goes into solution at a rate determined by its solubility constant and the system will not become laden with ammonium chloride.

After passing through the additive unit 13, the etchant passes into the reactor tank 33. A mixing device 34 is provided in this tank to maintain constant movement of the solution therein and to primarily maintain the copper salts formed therein in suspension so that no settling and subsequent compacting of the salts will occur in this tank.

Within the reactor tank the copper laden etchant is reacted with hydrochloric acid to form the complex copper ammonium chloride salts. Hydrochloric acid is provided from a source 35 through a pump 36 which pump is controlled by a pH monitor 37 which constantly monitors the pH of the tank 33. For proper formation of the copper salts, the pH within the reactor tank is held within the range of 6.8 to 7.5. The reduction in pH is obviously obtained by the introduction of hydrochloric acid into the reactor tank 33.

As the liquid level in the reactor tank 33 increases, it reaches an output level at which the etchant begins to flow, through gravity, to the receptacle 38. Located within this receptacle 38 is a filter 43. Intermediate of the reactor tank 33 and the receptacle 38 is a flow sensing switch 39 which is arranged to control a pump 40 located to draw fluid through the filter 43 through means of a venturi 41. The filter 43 is sized to prevent the transmission of the copper salts from the receptacle 38 and thus they are trapped in the barrel 38. The barrel or receptacle 38 is arranged for removal from the circuit such that upon filling thereof it may be removed and replaced.

The flow switch and pump combination 39, 40 are provided with a time delay such that the pump 40 will continue to operate for a period of time after the flow from the reactor tank 33 has ceased. The cessation of such flow is obviously caused by the specific gravity monitor 28 in the ammoniating circuit 11. When the specific gravity of the etchant has dropped to a proper lower level, the dual head pump 32 will be deenergized and there will be no flow through the precipitation or material removal circuit 12.

The etchant from the receptacle 38, through the filter 43, is delivered to a feed tank 42. The feed tank, in this form, serves only as a reservoir for etchant to be delivered to the etcher 10 through the dual pump 32. As previously stated, the pump 32 is dual headed and its purpose is to withdraw etchant from and supply etchant to the etcher simultaneously. This could be accomplished with two single interconnected pumps.

In this first form of the invention, the ammonium chloride additive unit is illustrated in the flow line prior to the reactor tank 33. The endothermic reaction obtained by the introduction of ammonium chloride to the etchant will counteract the exothermic resulting from the introduction of hydrochloric acid to the etchant in the reactor tank 33.

The principle available in any of the various forms of the invention, without regard to the placement of the ammonium chloride additive unit, is to provide a means for removal of the copper salts from the etchant and to thereafter recycle this filtered etchant back to the etcher. Obviously, the pH of the etchant, after the introduction of the hydrochloride acid is substantially lower than that required for proper etching. Upon introduction of the etchant from the feed tank 42 into the etcher, the constant recycling of the etchant from the etcher to the ammoniating circuit will result in raising of the pH to the required and desired level.

In the form of the invention wherein the additive unit is designated 14, the ammonium chloride is delivered to the feed tank. This may be accomplished by diverting a portion of the fluid from the venturi 41 to this unit or may be accomplished by providing a by-pass unit, which may consist of a separate pump, for delivery of etchant to such unit.

A form of an ammonium chloride additive unit is illustrated in FIG. 2. In the form illustrated therein, a housing 50 is provided having a removable cover 51 and an inlet for etchant received, 52, in the cover portion thereof. Below the cover 51, a filter bag, capable of retaining an ammonium chloride supply is provided. An outlet 54 is provided on the side of housing 50 and the inlet level thereof is positioned to expose the etchant to the ammonium chloride for proper absorption thereof. The outlet from this unit is directed either to the reactor tank 33 or the feed tank 42.

A second form of the ammonium chloride additive unit is illustrated in FIG. 3. As shown therein, a housing 55 is provided and this housing 55 is provided with a separating baffle 56 having a fluid flow aperture or apertures 57 at the lower end thereof. This baffle 56 divides the housing into two compartments 58, 59 compartment 59 being filled with the ammonium chloride to be added to the etchant. A cover unit 61 is provided and an inlet 60 is provided through the cover for the introduction of etchant to the compartment 58. The housing 55 is provided with an outlet 62 communicating with the ammonium chloride compartment 59 and the flow of the etchant through the unit is obviously through the ammonium chloride.

Each of these additive units are arranged for ease of filling with additional ammonium chloride.

In a further modified form of the invention, wherein the additive unit is designated 15, the ammonium chloride is added directly to the etcher.

The introduction of the ammonium chloride into the etcher may be accomplished on a time or etch rate basis. The ammonium chloride may be introduced into the etcher in either a dry or solution condition. In a dry condition, an auger feed may be utilized and in a fluid solution condition a metering pump may be utilized.

With applicant's device, the etchant removed from the etcher for the removal of the copper ions therefrom is reused rather than discarded. The etchant returned to the etcher will be of a lower pH than that normally available in the etcher for proper etching rates but in practice, the amount of etchant removed at any one time and replaced to the etcher after material precipitation will not be sufficient to stop the etching procedure. Rather, the continuity of operation is obtained by not lowering the pH during precipitation to such an extent that total ammoniation of the etchant within the etcher would be required. The etchant returned to the etcher is obviously of a lower specific gravity than that delivered from the etchant and this situation is necessary for the continued and continuous etching of material in the etcher.

The recovery of the copper salts from the etchant, while etching is continually being performed is thought and believed to be unique to the art particularly when the entire etchant remains in the system and is not discarded for subsequent removal of the material removed by the etching process.

This continuous situation is obtainable with the combination of elements disclosed herein which insures a constant supply of etchant within proper limitations of operation for proper etching such that the etcher will not have to delay its operation until the required parameters of operation are reached. These parameters of operation include a proper pH level, a proper specific gravity level and a proper operating temperature.

It should be obvious that applicant has provided a system, including the necessary apparatus for the operation thereof, which will permit the continuous operation of an etching device and which will not require the abandonment of the etchant for the unit but will rather permit the reuse of the same and will include in its operation the process for recovering the material that is removed during the etching process.

What I claim is:

1. A system and apparatus for the continuous regeneration and reuse of alkaline etchant for the etching of copper material which apparatus includes an etching device in which the material to be etched is placed for exposure to the etchant material, said system and apparatus including:

a. a copper precipitation and removal circuit arranged to receive etchant from and redeliver the same, after removal of copper therefrom, to the etching device, said circuit including:

1. first fluid pumping means for withdrawing copper bearing etchant from the etching device and returning etchant to the etching device after removal of the copper therefrom;
2. a source of hydrochloric acid;
3. means for introducing hydrochloric acid to the etchant withdrawn from the etching device to lower the pH thereof and form copper salts therein;
4. filter means for removal of the formed copper salts from the etchant;
5. means for delivering the exposed etchant to said filter means; and,
6. means for delivering the etchant, subsequent to filtering, to said fluid pumping means.

2. The system and apparatus as set forth in claim 1 and:

a. a reactor container arranged to receive the copper bearing etchant from said pumping means; and,
b. said means for introducing the hydrochloric acid directing the acid to said reactor.

3. The system and apparatus as set forth in claim 2 and means for controlling the introduction of hydrochloric acid to the copper bearing etchant including means to sense the pH of the etchant within said reactor.

4. The system and apparatus as set forth in claim 3 and said hydrochloric acid introduction control means arranged to maintain the pH within said reactor in the range of 6.8 to 7.5.

5. The system and apparatus as set forth in claim 1 and said filter means including a salt retaining container arranged to receive etchant subsequent to hydrochloric acid addition, said container and filter arranged to filter the salts from the etchant for storage in said container.

6. The system and apparatus as set forth in claim 5 and said salt retaining container being removable from and replaceable in said circuit.

7. The system and apparatus as set forth in claim 1 and storage means arranged to receive filtered etchant from said filter means.

8. The system and apparatus as set forth in claim 7 and second pumping means arranged to draw etchant through said filter for delivery thereof to said storage means.

9. The system and apparatus as set forth in claim 8 and means controlling said second pumping means, said controlling means being responsive to the means for delivering the exposed etchant to said filter means.

10. The system and apparatus as set forth in claim 9 and said second pumping controlling means actuating said second pumping means upon the delivery of etchant to said filter and deactivating said second pumping means a predetermined period of time following the cessation of etchant delivery to said filter.

11. The system and apparatus as set forth in claim 1 and specific gravity sensing means arranged to sense the specific gravity of the etchant within the etching device and activating said first pumping means in response to a predetermined reading thereof.

12. The system and apparatus as set forth in claim 1 and means for introducing ammonium chloride into said circuit.

13. The system and apparatus as set forth in claim 12 and said means for the introduction of ammonium chloride being arranged for such introduction prior to the introduction of hydrochloric acid to the etchant.

14. The system and apparatus as set forth in claim 12 and said means for introduction of ammonium chloride being arranged for such introduction to such etchant subsequent to the filtering thereof.

15. The system and apparatus as set forth in claim 1 and;

a. an ammonia introduction circuit arranged to receive etchant from and deliver the same to the etching device, including:

1. an ammoniating tower;

2. third pumping means for receiving etchant from the etching device and delivering the same to said tower;

3. a source of ammonia connected to said tower for the delivery of ammonia there; and, 4. means for controlling the delivery of ammonia to said tower from said source.

16. The system and apparatus as set forth in claim 15 and said ammonia circuit including pH sensing means associated with said delivery controlling means for controlling the delivery of ammonia to the etchant.

* * * * *